United States Patent [19]

Anderson et al.

[11] 4,205,487

[45] Jun. 3, 1980

[54] WORKPIECE HOLDING APPARATUS FOR SPINDLE FINISHING MACHINES AND THE LIKE

[75] Inventors: Gordon H. Anderson; John L. Cicha, both of Albert Lea; Steven R. Johnson, Hayward, all of Minn.

[73] Assignee: King-Seeley Thermos Co., Ann Arbor, Mich.

[21] Appl. No.: 889,961

[22] Filed: Mar. 24, 1978

[51] Int. Cl.[2] ..... B24B 31/08

[52] U.S. Cl. ..... 51/7; 51/217 T; 51/235; 279/43

[58] Field of Search ..... 51/7, 19, 216 T, 217 T, 51/235, 237 M, 237 T; 279/1 Q, 41 R, 43, 46 R, 54, 55

[56] References Cited

U.S. PATENT DOCUMENTS

| | | | |
|---|---|---|---|
| 838,528 | 12/1906 | Embler | 51/217 T |
| 1,708,569 | 4/1929 | Fotheringham | 51/237 T |
| 2,218,353 | 10/1940 | Gruenberg | 51/7 |
| 2,560,111 | 7/1951 | Hulse | 51/237 T |
| 2,688,220 | 9/1954 | Boutell | 51/235 |
| 3,623,278 | 11/1971 | Schwartz | 51/7 X |

*Primary Examiner*—Gary L. Smith

*Attorney, Agent, or Firm*—Harness, Dickey & Pierce

[57] ABSTRACT

A workpiece holding apparatus for spindle finishing machines and the like, the apparatus including a plurality of radially arranged workpiece holders mounted for rotation about a first axis and including cooperating gear elements for rotating each of the holders about its respective longitudinal axis in response to rotation of the entire assemblage of holders about the first mentioned axis; a cam arrangement is provided whereby each of the holders may be actuated between a first condition securing workpieces on the holders and a second condition permitting workpieces to be removed, such as after a finishing operation has been completed.

4 Claims, 8 Drawing Figures

FIG. 4.
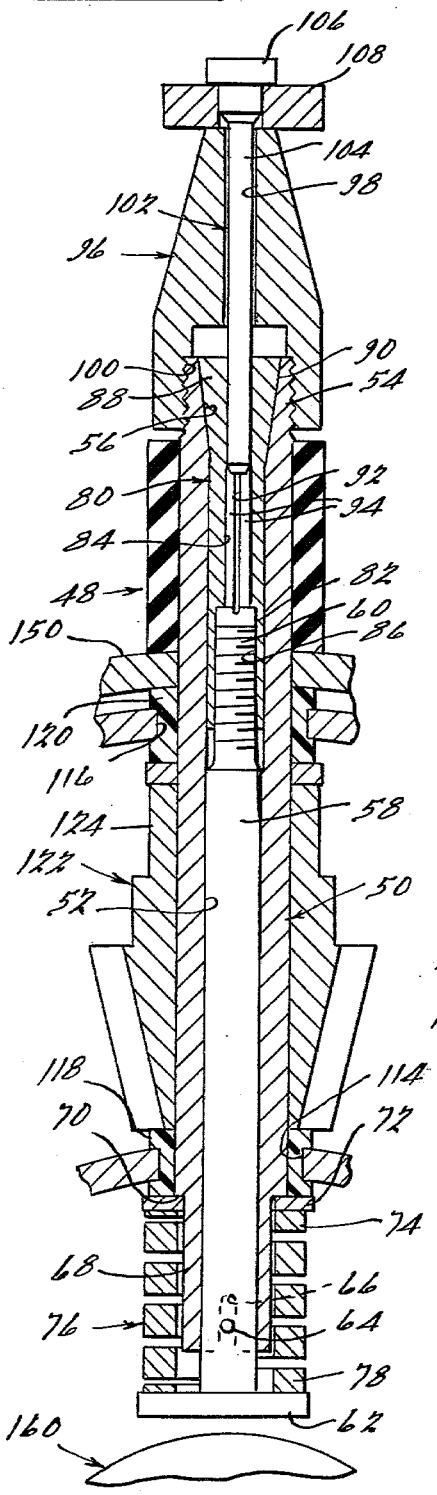
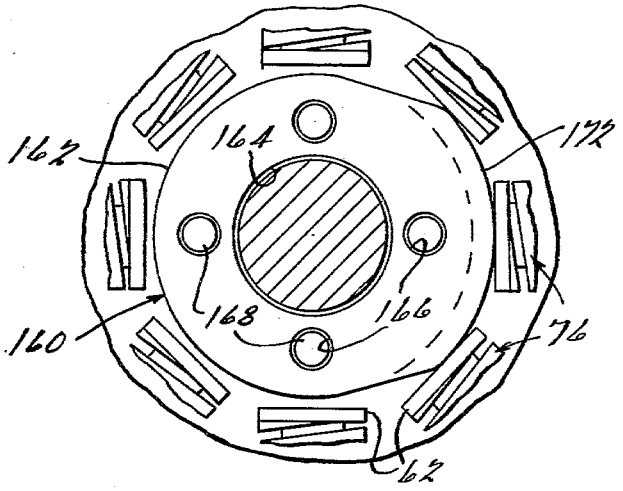
FIG. 5.
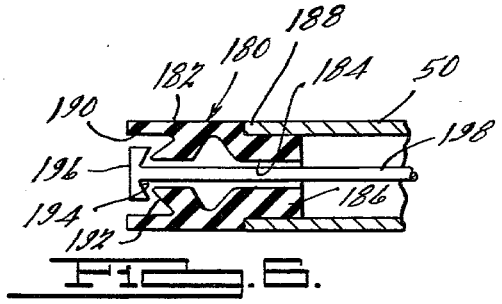
FIG. 6.
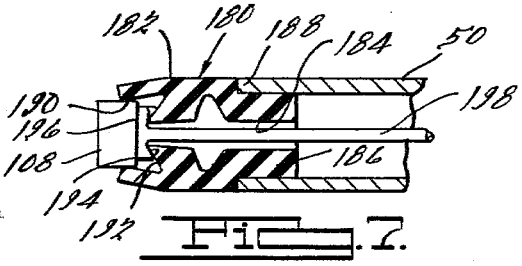
FIG. 7.
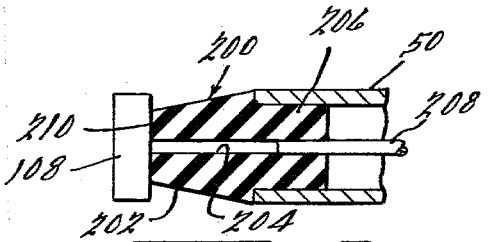
FIG. 8.

WORKPIECE HOLDING APPARATUS FOR SPINDLE FINISHING MACHINES AND THE LIKE

BACKGROUND AND SUMMARY OF THE INVENTION

The present invention relates generally to spindle finishing machines and more specifically, to workpiece holders for use in supporting workpieces while they are subjected to a finishing operation within a mass of rotating finishing media. In particular, the present invention relates to a new and improved workpiece holding apparatus wherein in workpieces are subjected to a compound rotational movement during the finishing operation so that the workpieces are uniformly finished in a minimum amount of time. Such movement is accomplished through the provision of a novel turret head having a plurality of radially disposed workpiece holders, each of which are intended to rotate about a common upwardly inclined rotational axis, and simultaneously, each of the workpiece holders is rotated about its respective longitudinal axis through the provision of cooperating gear elements located within the turret head. The workpiece holders are provided with workpiece retaining means, such as spring biased collets, that are adapted to be selectively actuated between a first condition wherein the workpieces are positively secured to the outer ends of the holders, and a second condition wherein the workpieces may be removed and replaced with new workpieces to be finished during a subsequent rotational cycle of the turret head. Actuation of the workpiece holders is achieved through the provision of a novel camming arrangement which cooperates with the draw rods and collets of the respective workpiece holders, with the particular cam means being selectively located such that the workpiece holders are actuated to their respective "release" condition as the workpieces carried thereon are rotated out of the mass of finishing media. Alternate embodiments of the present invention include workpiece retaining heads that may be clampingly engaged directly with the workpieces, or instead, with retaining pins which temporarily support the workpieces on the workpiece holders during a finishing operation. Yet another alternative arrangement utilizes a vacuum source for releasably securing the workpieces upon the workpiece holders.

It is accordingly a general object of the present invention to provide a new and improved workpiece holding apparatus for use with spindle finishing machines and the like.

It is a more particular object of the present invention to provide a new and improved workpiece holding apparatus which includes means for applying a positive driving force to the workpieces as they are being finished so as to assure uniformity of the finishing operation.

It is still a further object of the present invention to provide a workpiece holding apparatus, as above described, wherein the workpieces are positively retained in place by a unique spring set collet arrangement.

It is a further object of the present invention to provide a workpiece holding apparatus, as above described, wherein the workpieces are subjected to a compound rotational movement, and wherein the workpiece holders may be selectively actuated to release the workpieces by means of a cam arrangement disposed interiorly of the workpiece turret head.

It is still a further object of the present invention to provide a new and improved workpiece holding apparatus that will find universality of application with various types of spindle finishing machines and which is of a relatively simple design, durable construction and will therefore have a long and effective operational life.

Other objects and advantages of the present invention will become apparent from the following detailed description, taken in conjunction with the accompanying drawings.

BRIEF DESCRIPTION OF THE DRAWINGS

FIG. 4 is a longitudinal cross-sectional view taken substantially along the line 4—4 of FIG. 3;

FIG. 5 is an enlarged fragmentary cross-sectional view taken substantially along the line 5—5 of FIG. 3;

FIG. 6 is a fragmentary cross-sectional view of a slightly modified embodiment of one of the workpiece holders incorporated in the present invention;

FIG. 7 is a view similar to FIG. 6 and illustrates the work holding element illustrated therein in an actuated or clamped position; and FIG. 8 is a view similar to FIGS. 6 and 7 and illustrates yet another embodiment of the present invention.

DESCRIPTION OF THE PREFERRED EMBODIMENTS

Figure 1:
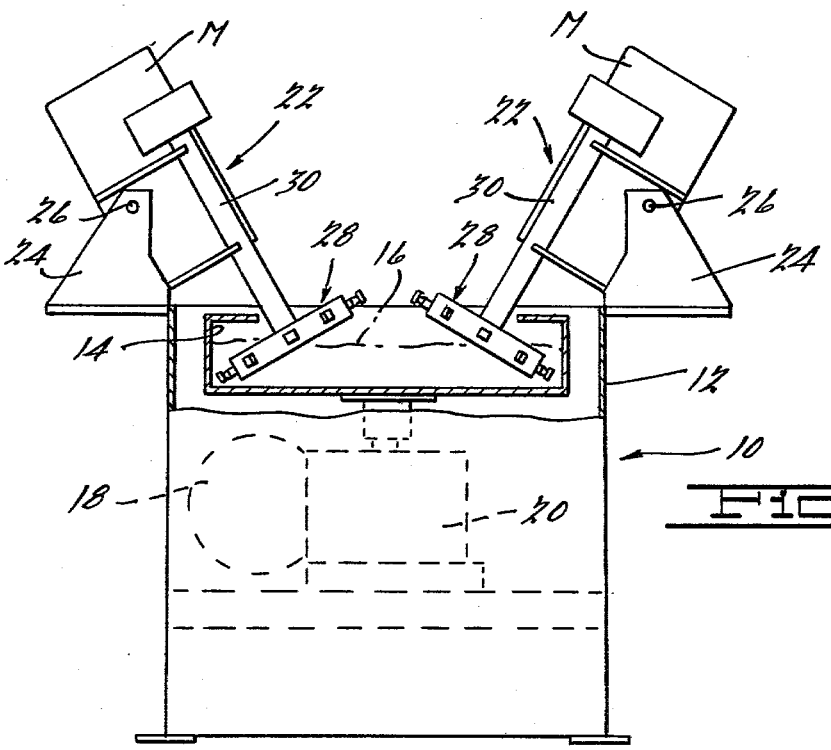
FIG. 1 is a side elevational view of a spindle finishing machine embodying the new and improved workpiece holding apparatus of the present invention.

Referring now in detail to the drawings and in particular to FIG. 1 thereof, a spindle finishing machine 10 is shown generally as comprising a housing or support structure 12 and having a finishing chamber 14 located adjacent the upper end thereof. Disposed within the chamber 14 is a mass of finishing media 16 which is intended to perform a finishing, deburring or analogous manufacturing operation upon suitable workpieces that are brought into contact with the finishing media as the finishing chamber 14 undergoes an oscillatory or other rotating movement as a result of operation of a suitable drive motor 18 and gear box drive assembly 20 which are typically located interiorly of the support structure 12 beneath the finishing chamber 14, as is well known in the art.

In accordance with the principles of the present invention, the finishing machine 10 is provided with a new and improved workpiece holding apparatus, generally designated by the numeral 22, and detailed description of the operation and construction of which will hereinafter be presented. By way of example, the machine 10 is shown as being provided with two of the apparatus 22, although it is to be noted that the scope of the present invention is not limited to such an arrangement since a single apparatus 22 or more than two thereof may be utilized with a single finishing chamber 14, depending upon the size of the chamber and the particular type of finishing operation to be performed. Accordingly, the following description of one of the workpiece holding apparatus 22 is intended to be applicable to both apparatus depicted in FIG. 1.

Figure 3:
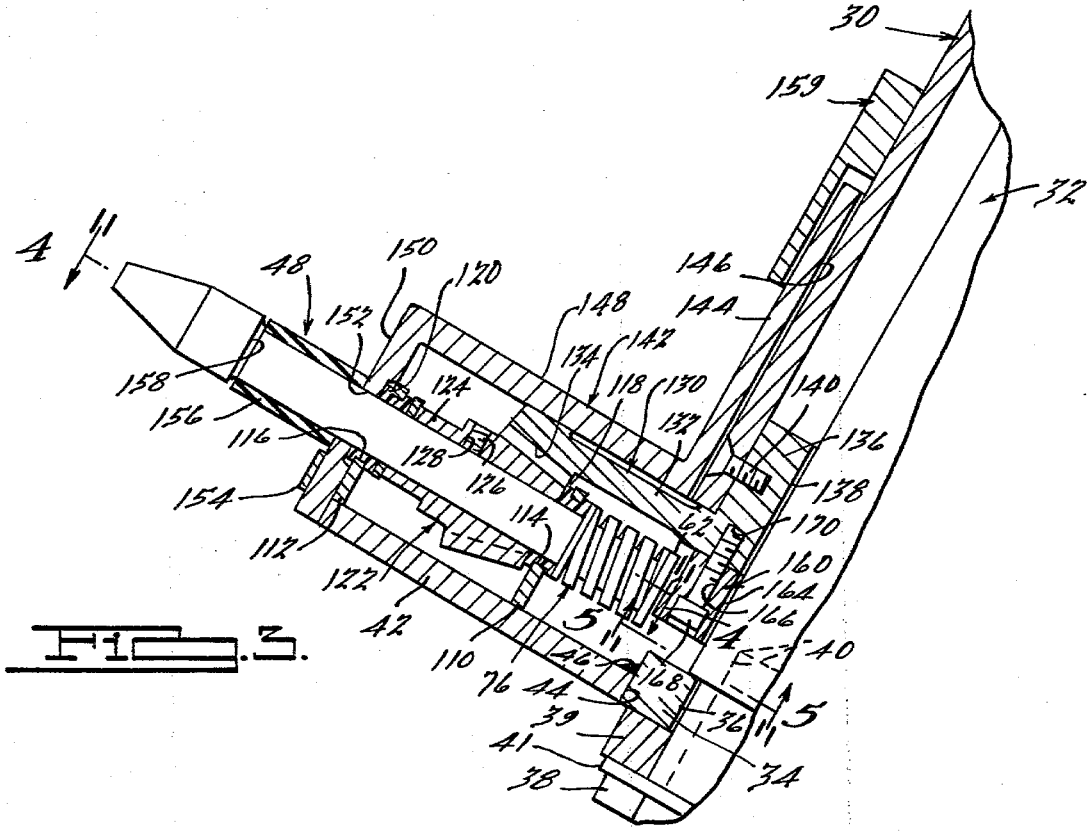
FIG. 3 is a transverse cross-sectional view of a portion of the structure shown in FIG. 2.
Figure 2:
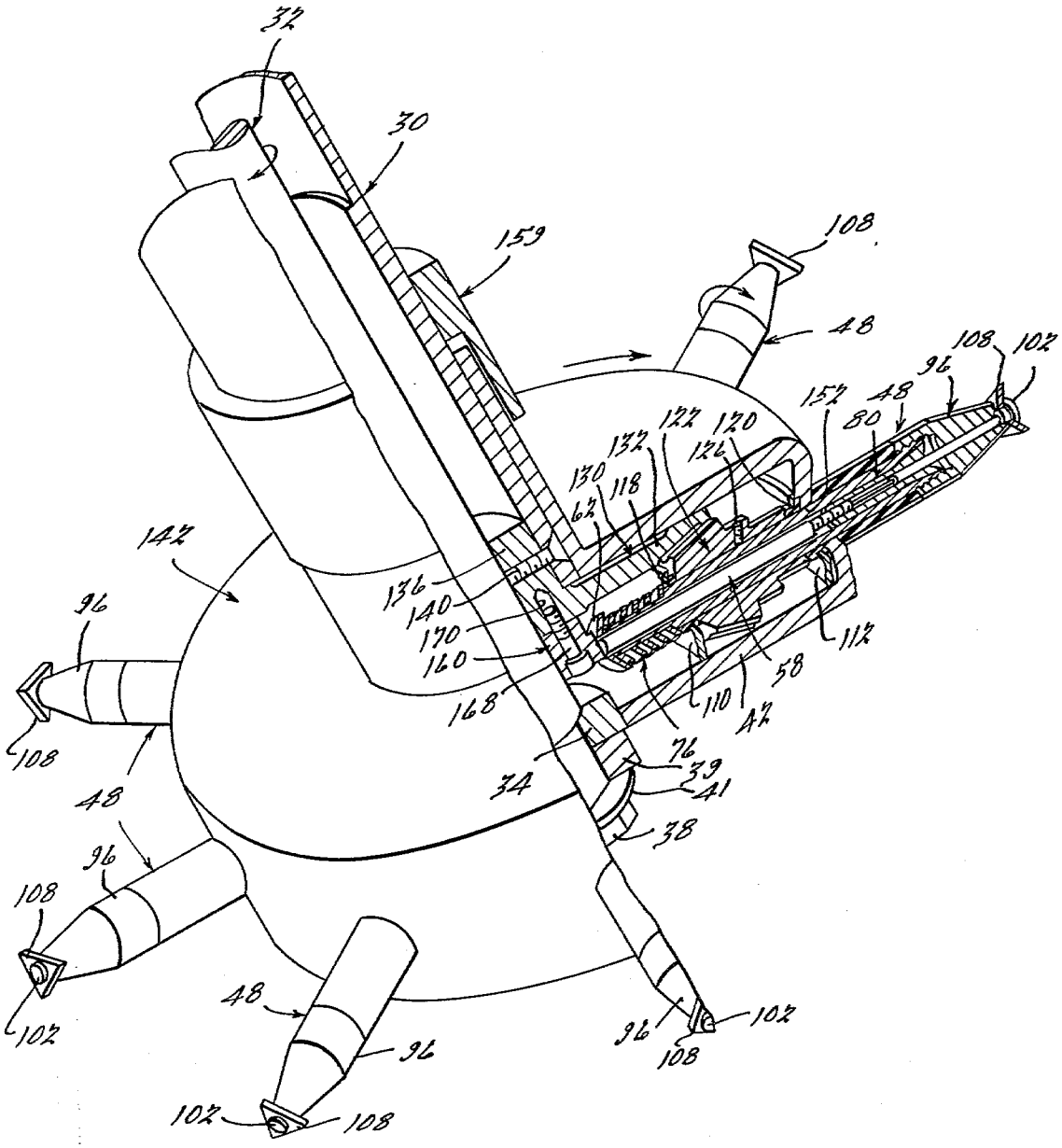
FIG. 2 is an enlarged elevated perspective view, partially broken away, of one of the workpiece holding apparatus shown in FIG. 1.

The apparatus 22 includes a suitable support platform 24 which is fixedly mounted adjacent the upper end of the structure 12 and is intended to pivotably support a suitable drive motor M for tilting movement about a horizontal pivotal axis 26 such that the spindle or turret head 28 of the apparatus may be moved into and out of the chamber 14 for purposes of inspecting the workpiece holders, repair, maintenance, etc. As best seen in FIGS. 2 and 3, the apparatus 22 includes an elongated tubular housing 30 that has its upper end mounted adjacent the motor M and extends downwardly at a preselected angle toward the finishing chamber 14, the lower end of the housing 30 terminating adjacent the mass of finishing media 16, as illustrated. Disposed coaxially within the housing 30 is an elongated rotatable drive shaft 32, the upper end of which is drivingly connected to the associated drive motor M and the lower end of which is provided with a suitable hub 34 which is formed with a central aperture 36. The hub 34 is operatively secured to the drive shaft 32 by means of a suitable threaded fastener, such as a screw, bolt or the like 38 which extends upwardly through an annular spacer 39 and is threadably received within a blind bore 40 extending axially upwardly within the lower end of the shaft 32. A suitable washer element 41 is preferably provided between the head of the fastener 38 and underside of the spacer 39, as illustrated. Disposed radially outwardly from the hub 34 is an annular base plate 42 which is formed with a central opening 44 within which the outer periphery of the hub 34 is disposed, the base plate 42 being fixedly secured to the hub 34, as by welding or the like indicated at 46. As will be apparent, the hub 34 and base plate 42 are intended to rotate concurrently with and about the same rotational axis as the drive shaft 32 upon energization of the associated motor M.

In accordance with the present invention, the spindle or turret head 28 is provided with a plurality of workpiece holders which are identical in construction and operation and are generally designated by the numeral 48. By virtue of their identity, the following description of one of the workpiece holders 48 is intended to be applicable to each of the plurality thereof which, by way of example, consists of eight holders 48 that are spaced circumferentially about the turret head 28 and extend radially outwardly therefrom. As seen in FIGS. 3 and 4, the workpiece holder(s) 48 comprises an elongated tubular housing 50 which defines a central passage 52 and has a reduced diameter externally threaded end portion 54 on the radially outer end thereof. The central passage 52 is of generally uniform diameter with the exception of the radially outer end thereof which is provided with a radially outwardly inclined or tapered section 56. Extending longitudinally within the passage 52 is an elongated draw rod 58 which is formed with a reduced diameter externally threaded portion 60 on the radially outer end thereof and with a radially outwardly projecting flange or head portion 62 on the radially inner end thereof. The draw rod 58 is provided with a radially outwardly extending pin or boss 64 adjacent the head portion 62 which is slidably received within a generally U-shaped recess 66 formed in the adjacent end of the housing 50 for preventing relative rotation between the draw rod 58 and housing 50, yet permitting limited reciprocal movement therebetween, as will be described. The radially inner end of the housing 50 is formed with a reduced diameter end portion 68 which defines a radial shoulder 70 against which an annular spring pad or washer 72 is resiliently biased by means of an end portion 74 of a helical coil spring 76 surmounted upon the end portion 68. The opposite end portion 78 of the spring 76 bears against the head portion 62 of the draw rod 58 for resiliently urging the draw rod radially inwardly relative to the associated housing 50, for purposes hereinafter to be described.

Disposed within the radially outer end of the housing 50 is an elongated collet member, generally designated by the numeral 80, which includes a tubular body 82 defining a central bore or passage 84. The radially inner end of the bore 74 is internally threaded, as seen at 86, and threadably engages the radially outer end 60 of the draw rod 58. The radially outer end of the collet 80 is formed with a frusto-conical section 88 which defines a tapered surface 90 adapted for engagement with the tapered section 56 of the passage 52, as illustrated. The collet 80 is formed with a plurality of circumferentially spaced, longitudinally extending slots 92 which extend from the radially outer end thereof to a position adjacent the threaded bore 84, whereby to define a plurality of relatively flexible finger sections 94 which are cantilever supported at the radially inner ends thereof and are intended to flex radially inwardly to a limited degree as the collet 80 is moved radially inwardly (with respect to the axis of the drive shaft 32), thereby clampingly engage a workpiece retaining pin hereinafter to be described.

The radially outer end of the workpiece holder 48 is provided with an annular nosepiece 96 which defines a central bore or passage 98 having an enlarged diameter, internally threaded counterbore 100 at the radially inner end thereof so as to be adapted for threaded engagement with the end portion 54 of the housing 50. The bore or passage 98 is adapted to telescopically receive a workpiece holding pin 102 having an elongated cylindrical shank section 104 which extends through the bore 98 to a position interiorly of the radially outer end of the bore 84 of the collet 80. The outer end of the pin 102 is provided with an enlarged diameter head section 106 for securing a workpiece, representatively designated by the numeral 108, to the outer end of the nosepiece 96. By way of example, the type of workpiece 108 with which the pin 102 may be used consists of a carbide tool insert or the like having a central opening for receiving the shank section 104 of the pin 102. The inner end of the section 104 is intended to be clampingly retained within the collet by having the plurality of flexible finger portions 94 thereof urged radially inwardly under the influence of the draw rod 58 being biased axially of the housing 50 by the coil spring 76, the interaction of the tapered surfaces 56, 90 effecting such clamping action of the finger portions 94 as the collet 80 is thus moved longitudinally within the housing 50.

The plurality of workpiece holders 48 are operatively supported upon the base plate 42 by means of radially inner and outer support members 110 and 112 which are affixed at their lower ends to the base plate 42. The supports 110, 112 are provided with annular radially aligned pairs of openings 114, 116, respectively, within which the workpiece holders 48 are rotatably or journally disposed, whereby each of the workpiece holders 48 is relatively rotatable about its respective longitudinal axis. Suitable anti-friction bearing means 118, 120 is preferably interposed between the periphery of the openings 114, 116 and the outer periphery of the respective tubular housings 50, whereby to provide for relatively free rotational movement of the workpiece holders 48 with respect to the supports 110, 112.

In accordance with the present invention, the workpiece holders 48 are positively rotationally driven with respect to the base plate 42 by means of each of the tubular housings 50 thereof being provided with a gear element, generally designated by the numeral 122. As illustrated, each of the gear elements 122 includes an annular sleeve section 124 adapted to be surmounted upon the associated workpiece holder housing 50 and be secured thereto by a suitable set screw or the like 126 mounted within an associated threaded bore 128. The plurality of gear elements 122 are operatively associated with a fixed gear member 130 which is arranged coaxially of the base plate 42 and includes a generally radially extending portion 132 provided with suitable gear teeth 134 adapted for meshing engagement with the plurality of aforementioned gear elements 122. The fixed gear member 130 includes a generally axially extending annular section 136 defining a central bore 138 through which the lower end of the shaft 32 extends, the section 136 being fixedly secured to the inner periphery of the housing 30 by means of suitable screws, bolts or the like 140.

Briefly, in operation of the spindle or turret head 28, rotation of the shaft 32 will cause concomitant rotation of the base plate 42 and plurality of workpiece holders 48 about the rotational axis of the shaft 32. By virtue of the driving engagement of the gear elements 122 on each of the workpiece holders 48 with the fixed gear member 130, rotation of the workpiece holders 48 about the axis of the shaft 32 will result in simultaneous rotational movement of each of the workpiece holders 48 about their respective longitudinal axis and hence workpieces that are carried by the workpiece holders 48 are subjected to a compound rotational movement consisting of rotation about the axis of the shaft 32 as well as rotation about the longitudinal axis of the associated workpiece holder 48.

Disposed on the upper side of turret head 28 is a protective shroud or enclosure which is fabricated, for example, of a suitable abrasive resistant material, such as urethane or the like, and is generally designated by the numeral 142. The shroud 142 includes an annular axially extending section 144 which defines a cylindrical bore 146 through which the lower end of the housing 30 extends, with the inner periphery of the bore 146 being spaced slightly radially away from the outer surface of the housing 30, as shown in FIG. 3. Integrally connected to the lower end of the section 144 is a radially outwardly extending section 148, the radially outer end of which is provided with a downwardly depending skirt portion 150 that is formed with a plurality of circumferentially spaced, radially extending openings 152 through which the outer ends of the workpiece holders 48 extend. The shroud 142 is fixedly secured upon the base plate 42 by any suitable means, such as a clamping strip or the like 154, whereby the shroud 142 is rotatable concurrently with the base plate 42 and workpiece holders 48 about the rotational axis of the shaft 32. Preferably, each of the workpiece holders 48 is provided with a protective sleeve 156 which extends between the skirt portion 150 of the shroud 142 and a radial shoulder 158 defined by the radially inner end of the associated nosepiece 96. Additionally, a suitable protective sleeve or collar 159 is fixedly secured to the outer surface of the tubular housing 30 and depends downwardly over the upper end of the shroud 142 to prevent finishing media contaminants, etc., from entering into the annulus between the housing 30 and shroud 42 and into the interior of the turret head 28.

In accordance with another of the principles of the present invention, the plurality of workpiece holders 48 are adapted to be selectively actuated from a condition wherein the associated workpiece holding pin 104 is clamped within the holder 48, to a condition wherein the workpiece holding pin 102 may be withdrawn from the outer end of the holder 48, whereby the workpiece 108 may be removed and a new workpiece 108 may be reinstalled on the workpiece holder 48 during a subsequent finishing cycle. Toward this end, an annular cam member is mounted on the under side of the fixed gear 130 coaxially of the rotational axis of the shaft 32. The cam 160 includes a generally ring-shaped body 162 having a central opening 164 through which the lower end of the shaft 32 passes. As seen in FIG. 5, the body 162 is formed with a plurality of circumferentially spaced openings 166 through which suitable threaded fastening members, such as screws, bolts or the like 168 extend, the upper ends of the screws 168 being threadably received within suitable threaded blind bores 170 formed in the underside of the fixed gear section 136, whereby the cam 160 is fixedly (non-rotatable) disposed within the turret head 28. As illustrated in FIG. 5, the outer periphery of the cam 160 is of a generally circular configuration, with the exception of a radially outwardly projecting cam lobe portion 172 which is of an arcuate distance consistent with the number of workpiece holders 48 which are to be actuated to a released condition, as above described. More specifically, and as shown in FIG. 5, the circular peripheral portion of the cam 160 is spaced radially inwardly away from the confronting surfaces of the draw rod head portions 62 so that the draw rods 58 are normally not affected by the presence of the cam 160 and hence retain the associated collets 80 in a clamped condition due to the action of the springs 76; however, when the workpiece holders 48 rotate to a position in registry with the lobe portion 172 of the cam 160, the head portions 62 of the draw rods 58 are biased radially outwardly against the resistance of the associated springs 76 so that the collets 80 are actuated to a "release" condition, permitting withdrawal of the associated workpiece holding pins 102. It will be appreciated, of course, that the arcuate length of the lobe portion 172 may be varied in accordance with the number of workpiece holders 48 that are to be released at any one time during each revolution of the base plate 42 and workpiece holders 48 carried thereon. By way of example, the arcuate length of the lobe portion 172 disclosed in FIG. 5 is approximately 90° and hence three of the eight disclosed workpiece holders 48 are released at any one time. Of course, the arcuate length of the lobe portion 172 may be varied to have either more or less workpiece holders 48 thus actuated. In the particular embodiments disclosed herein, and in accordance with another feature of the present invention, the cam 160 is rotationally oriented with respect to the housing 30 such that the lobe portion 172 is engaged by the workpiece holder draw rods 58 as the holders 48 (and workpieces carried thereby) rotate in an arc out of the finishing media 16. Accordingly, an operator may conveniently remove the workpiece holding pins 102 and workpieces 108 thereon and insert a new pin 102 and workpiece 108 before the particular holder 48 rotates back into the mass of finishing media 16, and thus the arcuate length of the lobe portion 172 is oriented and selected such that each draw rod 58 moves out of engagement with the lobe portion 172 prior to the associated holder 48 rotating back into the media 16 so as to assure that the associated holding pin 102 is positively clamped by the collet 80 under the influence of the spring 76.

FIGS. 6 and 7 illustrate a slightly modified embodiment of the present invention wherein the workpiece holder, instead of being provided with a collet-type arrangement, as is disclosed in FIGS. 1-5, is provided with a workpiece retaining head 180 which is intended to selectively retain workpieces 108 of the type which may not have a suitable central opening therein with which a workpiece holding pin may be employed. In particular, the workpiece retaining head 180 disclosed in FIGS. 6 and 7 is fabricated with a relatively elastomeric body 182 formed with an elongated central bore 184 and having a reduced diameter mounting portion 186 adapted to be retained within an outer end portion 188 of the associated workpiece holder housing 50. The outer end of the body 82 is formed with a workpiece receiving recess 190 within which a portion of the workpiece, such as indicated at 108 in FIG. 7, is intended to be received and retained during a finishing operation. Retention of the workpiece 108 within the recess 190 is achieved by causing the outer peripheral end of the head 180 to be deformed inwardly from the position shown in FIG. 6 to the position shown in FIG. 7 wherein the workpiece 108 is clampingly secured at least in part, within the recess 190. Means for thus deforming the head 180 includes a generally frustoconical clamping surface 192 formed around the inner end of the recess 190 and cooperable with a complementary-shaped surface 194 formed on a head portion 196 of a draw rod 198 that is analogous in construction and operation to the aforementioned draw rod 58. In particular, the draw rod 198 is normally biased toward the position shown in FIG. 7 by an associated coil spring acting on the opposite end thereof from that shown in FIGS. 6 and 7, for example, by a coil spring 76, thereby retaining the workpiece 108 within the recess 190. At such time as the workpiece holder rotates to a position in radial alignment with an associated cam (not shown), the lobe of the cam will bias the draw rod outwardly from the position shown in FIG. 7 to the position shown in FIG. 6 thereby releasing the workpiece 108 and permitting a new workpiece to be inserted in its place. As the holder continues to rotate, the draw rod 98 will move out of engagement with the associated cam lobe so that the rod 198 will again be biased under the influence of the aforementioned spring to the clamping position shown in FIG. 7.

FIG. 8 illustrates one additional embodiment of the present invention wherein the outer end of a workpiece holder is provided with a retaining head 200 consisting of a suitable body 202 defining a longitudinal bore or passage 204. The body 202 also includes a reduced diameter mounting section 206 retained within the outer end of the associated workpiece holder housing 50 and permitting the bore 204 to be in operative communication with a vacuum conduit, representatively designated by the numeral 208, which is in turn connected to a suitable source of vacuum pressure. As will be appreciated by those skilled in the art, by virtue of the vacuum condition thus provided within the bore 204, workpieces 108 placed in engagement with the outer end or face 210 of the head 200 will be secured thereto, for example, during a workpiece finishing operation. The conduit 208 may be connected through any suitable valving mechanism which may be operated, for example, by an associated cam, such as the cam 160, so that the vacuum condition existing within the bore 204 will be selectively interrupted or discontinued to permit the removal of a particular finished workpiece 108 and its replacement by a new workpiece 108 yet to be finished, as above described.

Assuming energization of the drive motor 18 to effect rotating movement of the finishing media 16, and further assuming energization of the drive motor M to cause rotation of the drive shaft 32, operation of the turret head 28 will occur as a result of rotational movement of the base plate 42 which, as previously described, effects simultaneous rotational movement of the plurality of workpiece holders 48 about the rotational axis of the shaft 32. As a result of the provision of the plurality of gear elements 122 and the fixed gear 130, each of the workpiece holders 48 will also rotate about its respective longitudinal axis, thereby subjecting the workpieces 108 carried thereon to the aforementioned compound rotational movement as the workpieces travel through the media 16. It is contemplated that the drive motor M will rotate the shaft 32 and workpiece holders 48 at a speed in the order of approximately one revolution per minute, and that the gear teeth on the elements 122 and gear member 130 are selected such that each of the workpiece holders 48 will rotate about its respective longitudinal axis at approximately six times of the rotational speed of the shaft 32, for example, approximately six revolutions per minute. At these speeds, the operator may conveniently remove finished workpieces off from each of the holders 48 as they rotate to a position out of the mass of finishing media 16 and may thereafter place a new workpiece to be finished on each workpiece holder 48 before it rotates back into the finishing media mass. It will be appreciated, of course, that such speeds may be varied considerably in accordance with the particular finishing media, type of workpiece, and the desired finishing operation, without departing from the present invention. It will also be appreciated that the principles of the present invention are not necessarily limited to use with spindle finishing machines since these principles could readily be applied to other manufacturing operations, such as coating operations and the like, as will be appreciated by those skilled in the art.

While it will be apparent that the preferred embodiments of the invention disclosed are well calculated to fulfill the objects above stated, it will be appreciated that the invention is susceptible to modification, variation and change without departing from the proper scope or fair meaning of the subjoined claims.

We claim:

1. An apparatus for releasably securing a plurality of workpieces during a finishing operation, said apparatus comprising, a plurality of generally radially disposed, circumferentially spaced workpiece holder elements, each of said workpiece holder elements including a first member having a workpiece engaging portion and a second member being actuatable with respect to said first member and coaxially of the respective holder element, to a first position during a work holding mode wherein a workpiece is releasably engaged with said portion of said first member, and to a second position during a work release mode wherein said workpiece is disengaged from said portion of said first member, said second member of each of said holder elements including clamping means for releasably supporting workpieces, and said holder elements further including spring means biasing said clamping means toward a position clampingly securing workpieces between said clamping means and the first member of the respective holder element during this work holding mode, a support structure supporting said elements for rotation about a first axis inclined from vertical, gear means responsive to rotation of said elements about said first axis for simultaneously rotating each of said elements about its respective longitudinal axis, whereby said elements sequentially move workpieces into and out of a mass of finishing media, first cam means fixedly mounted on said support structure and arranged generally coaxially of said first axis, second cam means associated with each of said holder elements and rotatable therewith about said first axis, said second cam means being engaged with said first cam means as said holder elements move about said first axis, with said first cam means being operable to effect actuation of said holder elements from said work holding mode to said work release mode after respective of said elements move their associated workpieces out of said mass of finishing media and then reactuate said holder elements from said work release mode to said work holding mode prior to said respective elements moving their said associated workpieces back into said mass of finishing media.

2. The invention as set forth in claim 1 wherein said support structure comprises a rotatable member and a shaft for effecting rotation of said member and said holder elements.

3. An apparatus for releasably securing a plurality of workpieces during a finishing operation, said apparatus comprising, a plurality of generally radially disposed, circumferentially spaced workpiece holder elements, each of said workpiece holder elements including a first member having a workpiece engaging portion and a second member being actuatable with respect to said first member and coaxially of the respective holder element, to a first position during a work holding mode wherein a workpiece is releasably engaged with said portion of said first member, and to a second position during a work release mode wherein said workpiece is disengaged from said portion of said first member, said first member of each of said holder elements including resilient clamping means for releasably supporting workpieces, and said second member of each of said holder elements including a draw rod actuated by the second cam member for engaging said resilient clamping means to clampingly engage workpieces during said work holding mode, a support structure supporting said elements for rotation about a first axis inclined from vertical, gear means responsive to rotation of said elements about said first axis for simultaneously rotating each of said elements about its respective longitudinal axis, whereby said elements sequentially move workpieces into and out of a mass of finishing media, first cam means fixedly mounted on said support structure and arranged generally coaxially of said first axis, second cam means associated with each of said holder elements and rotatable therewith about said first axis, said second cam means being engaged with said first cam means as said holder elements move about said first axis, with said first cam means being operable to effect actuation of said holder elements from said work holding mode to said work release mode after respective of said elements move their associated workpieces out of said mass of finishing media and then reactuate said holder elements from said work release mode to said work holding mode prior to said respective elements moving their said associated workpieces back into said mass of finishing media.

4. The invention as set forth in claim 3 wherein said support structure comprises a rotatable member and a shaft for effecting rotation of said member and said holder elements.

* * * * *